US006770810B2

(12) United States Patent
Wiebe et al.

(10) Patent No.: US 6,770,810 B2
(45) Date of Patent: Aug. 3, 2004

(54) HIGH VOLTAGE ELECTRICAL HANDLING DEVICE ENCLOSURE

(75) Inventors: Ernst H. Wiebe, Manitoba (CA); Caron Hopfner, Saskatchewan (CA)

(73) Assignee: The Manitoba Hydro-Electric Board, Winnipeg (CA)

( * ) Notice: Subject to any disclaimer, the term of this patent is extended or adjusted under 35 U.S.C. 154(b) by 0 days.

(21) Appl. No.: 10/364,512

(22) Filed: Feb. 12, 2003

(65) Prior Publication Data

US 2003/0168232 A1 Sep. 11, 2003

(30) Foreign Application Priority Data

Mar. 7, 2002 (CA) ..... 2375584

(51) Int. Cl.[7] ..... H01J 5/00

(52) U.S. Cl. ..... 174/50; 174/58; 220/4.02; 49/142; 312/326

(58) Field of Search ..... 174/170 A, 50, 174/170 T, 52.6, 58; 361/65, 90, 333, 690–697; 220/4.02; 312/216; 336/90; 49/142

(56) References Cited

U.S. PATENT DOCUMENTS

| | | | | |
|---|---|---|---|---|
| 3,014,158 A | * | 12/1961 | Nelson et al. | 361/41 |
| 3,758,828 A | * | 9/1973 | Stefani | 361/626 |
| 3,784,727 A | | 1/1974 | Haubein | |
| 3,841,032 A | | 10/1974 | Grannis, III | |
| 4,360,849 A | * | 11/1982 | Harris et al. | 361/39 |
| 4,533,786 A | | 8/1985 | Borgmeyer et al. | |
| 5,767,440 A | * | 6/1998 | Byron et al. | 174/17 VA |
| 5,783,775 A | | 7/1998 | Marusinec | |
| 6,066,802 A | | 5/2000 | Reinke et al. | |
| 6,140,572 A | | 10/2000 | Book | |
| 6,142,575 A | | 11/2000 | Allen | |

FOREIGN PATENT DOCUMENTS

| | | |
|---|---|---|
| CA | 1287868 | 10/1986 |
| CA | 2217619 | 10/1997 |

* cited by examiner

*Primary Examiner*—Dhiru R Patel
(74) *Attorney, Agent, or Firm*—Ryan W. dupuis; Adrian d. Battison; Michael R. Williams

(57) ABSTRACT

An enclosure is provided for a high voltage electrical handling device, for example a transmission transformer, having a housing containing high voltage electrical componentry and at least one connector supported externally of the housing in communication with the high voltage electrical componentry. The connector is at a high voltage, having a surrounding electrical corona field. The enclosure includes walls connected to the housing and surrounding the connector at high voltage. The walls are spaced outside of the electrical corona field of the connector. Using an enclosure on high voltage equipment permits the equipment to be supported on the ground without the necessity of elaborate protection systems as found in typical electrical power switchyards or substations.

13 Claims, 6 Drawing Sheets

HIGH VOLTAGE ELECTRICAL HANDLING DEVICE ENCLOSURE

FIELD OF INVENTION

The present invention relates in general to the application of enclosures and designs thereof for isolating and protecting high voltage electrical apparati.

BACKGROUND OF THE INVENTION

In electric utility networks, electrical power switchyards or utility stations and substations are commonplace to house and isolate electrical apparati such as power transformers, circuit breakers and switch gears which are essential for the transmission and distribution of electricity. In design, the transformers are conventionally connected to switching networks containing circuit breakers and switch gears to which the power lines are connected.

For example, a power transformer is a device for transferring electrical energy from one alternating-current circuit to another with a change in voltage, current, and/or phase. Commonly, a transformer consists of primary and secondary electrical windings that are magnetically linked via a ferromagnetic core (laminated or otherwise) in which the number of turns in each winding, hence the turns ratio between the windings, are varied so to manipulate the input and output characteristics of the transformer in accordance with Faraday's law. Accordingly, a transformer, depending on the turns ratio of its windings, may be classified as a step-up or a step-down transformer in its ability to generate a higher or lower output (secondary) voltage relative to the input (primary) voltage, respectively. A transformer that steps-up voltage would step-down current and vice versa and it is this ability of the transformer to increase or decrease voltage and current which lends to its primary use for the economical transmission and distribution of electrical power. For instance, step-up transformers are often used to transfer electrical energy from the generators to the transmission lines (voltages as high as about 750,000 volts) while step-down transformers from the transmission lines to the end-users (voltages of about 120 to about 240 volts). Most commercial transformers used are capable of handling single-phase or multiple-phase alternating current circuits in that, for example, a three-phase transformer would consist of three single-phase transformers constructed onto a single core. The gauge and material of the wires and the size, material and design of the core will overall determine the power handling capacity of a transformer.

By definition, transformers can be classified as distribution and transmission or power transformers. A distribution transformer (in accordance with the U.S. Department of Energy and ANSI IEEE C57.12.80-1978 (subsection 2.3.1.1)) is a transformer with a primary voltage of about 480 V to about 35 kV, a secondary voltage of about 120 V to about 600 V, a frequency of about 55–65 Hz, and a capacity of either about 10 kVA to about 2500 kVA for liquid-immersed transformers or about 0.25 kVA to about 2500 kVA for dry-type transformers. A transmission or power transformer, in comparison, is a transformer capable of handling primary and secondary voltages as well as capacities greater than those of a distribution transformer.

Low voltage distribution transformers are currently commercially available with diverse attributes. Due to the relatively lower voltages and currents involved, the input and output terminals (for conductor connections) are congregated on a single surface (usually the front) of the transformer. To further improve safety, pad-mounted distribution transformers are typically supplied only with bushing wells with molded rubber components for insulating energized componentry and inserts and elbows for insulated conductor connections. These attributes are industrially referred to as the "dead-front" design. Essentially, the dead-front layout is so designed or constructed to eliminate the exposure of and fully insulate current-carrying or energized parts that are normally exposed on the front of the transformer hence to simulate continuous and insulated conduction between the input or output conductor and the conductor connected to the windings of the transformer without any intervening functional componentry such as an insulator. In view of the above and the relatively lower hazards associated therewith, pad mounting of said distribution transformers at ground level with minimum containment measures is common practice in the industry. Examples of pad mounted, dead-front, low voltage systems are taught in Adkins et al. in Canadian Patent Application Number 2,217,619; Haubein in U.S. Pat. No. 3,784,727; Grannis in U.S. Pat. No. 3,841,032; Borgmeyer et al. in U.S. Pat. No. 4,533,786; Marusinic in U.S. Pat. No. 5,783,775; Reineke et al. in U.S. Pat. No. 6,066,802; and Book in U.S. Pat. No. 6,142,572 and Canadian Patent Number 1,287,868. These citations do not teach enclosure systems for live-front, high voltage transmission transformers.

Conversely, the significantly higher power ratings and voltages handled by transmission transformers render the use of the dead-front design impractical owing to the larger corona fields associated with high voltage conductor terminals and transmission transformers are currently only available in the live-front format in that glass or porcelain bushings with eyebolt or spade type terminals forming insulators are extended through the top side of the transformer so to insulate the transformer from the energized conductor terminals which insulator and conductor terminals and are fully exposed for connection to the conductors.

Transmission transformers are rated by their primary and secondary voltage relationship and their power carrying capability. For instance, a substation transformer rated at 66–13 kV and 5,000 kVA means that the primary or high voltage is 66,000 V, the secondary or low voltage is 13,000 V and the transformer has a power rating of 5,000,000 VA. Substation transformers, like most distribution transformers, consist of a core and coils immersed in oil in a steel casing. The oil serves as an insulator and coolant to maintain reliable operating temperatures, and certain transmission transformers incorporate pumps to circulate oil for better heat transfer, fins for the oil to circulate through and fans to force air across the fins.

To safeguard against the danger associated with prominently exposed energized componentry inherent with the live-front design of transmission transformers, the positioning of transmission transformers therefore requires pole mounting and/or isolation within large secured switch yard or substations. None of the above citations teach any enclosure system that can offer safety, security and cost savings that would be associated with pad mounting of live-front high voltage transmission transformers.

In view of the foregoing, the present invention provides a solution to containment of exposed high voltage electrical componentry, such as the insulator connections and the conductor terminals of a high voltage, live-front, transmission transformer, thereby reducing or eliminating the necessity for a conventional switchyard or substation and costs thereof.

SUMMARY OF THE INVENTION

An object of the invention is to provide novel means to contain and protect high voltage electrical apparati with exposed componentry thereby reducing or even eliminating the necessity for, and the high costs associated with conventional means for such containment and protection.

Another object of the invention is to provide a secure enclosure system for high voltage electrical apparati so to permit the placement of said high voltage electrical apparati at ground level.

According to a first aspect of the present invention there is provided a high voltage electrical handling device comprising a housing containing high voltage electrical componentry and at least one connector supported externally of the housing in communication with the high voltage electrical componentry, said at least one connector being at a high voltage and having a surrounding electrical corona field;

wherein the improvement comprises an enclosure comprising walls connected to the housing and surrounding said at least one connector at high voltage, spaced outside of the electrical corona field of said at least one connector.

The device preferably comprises a high voltage transmission transformer which may include a lower voltage connector and an upper voltage connector, each supported on a side of the housing and each having an enclosure surrounding the connector.

The connector is preferably spaced outwardly from the housing, supported at the free end of an insulator projecting from the housing in a live front configuration.

The connector may have a minimum phase to phase high voltage of at least 44,000 Volts, but preferably at least 60,000 Volts.

There may be provided at least one lower voltage connector supported on a first side of the housing and at least one upper voltage connector supported on a second side of the housing, both the upper and lower voltage connectors being enclosed by the enclosure.

In one embodiment, the enclosure comprises a first compartment surrounding said at least one lower voltage connector on the first side of the housing and a second compartment surrounding said at least one upper voltage connector on the second side of the housing.

The upper voltage connector may have a minimum phase to phase high voltage of at least 44,000 Volts, but preferably at least 60,000 Volts while the lower voltage connector has a lower voltage than that of the upper voltage connector. The upper voltage connector may have a maximum phase to phase high voltage of 250,000 Volts, but preferably a maximum phase to phase high voltage of 230,000 Volts.

The connector at high voltage is preferably only supported on a side of the housing with a top side of the housing being clear of any connectors.

The enclosure may include a door supported therein having locking means to restrict access by unauthorized persons. When there is provide a plurality of connectors at high voltage, the enclosure may include an access door supported therein in association with each of the connectors.

The access doors are preferably located in a primary common wall of the enclosure. An auxiliary door may also be located in a secondary wall of the enclosure.

In one arrangement, the enclosure is arranged for retrofitting existing high voltage electrical handling devices in the form a container having an open side for mounting adjacent the housing with said at least one connector at high voltage extending from the housing into the enclosure through the open side of the enclosure.

The enclosure is preferably arranged to be mounted onto the housing using threaded fasteners to avoid potential hazards incurred by welding.

When the enclosure includes an access door permitting access to an interior of the enclosure, there may be provided a secondary barrier supported within the enclosure for restricting access to said at least one connector through the access door, both the access door and the secondary barrier including locking means for restricting access to the surrounding electrical corona field of said at least one connector by unauthorized persons.

The secondary enclosure may comprise a grill permitting visual inspection therethrough, located outside of the electrical corona field of said at least one connector.

According to one aspect of the present invention there is provided a method of application and use of secure enclosure systems for attaching to high-voltage electrical apparati thereby containing and protecting exposed componentry thereof.

In one embodiment, the high voltage electrical apparati hereof are high voltage, live-front, transformers or high voltage circuit breakers.

In another embodiment, the inventors contemplate the use of a secure containment system of the present invention on a high voltage electrical apparati at ground level so to facilitate access and maintenance by authorized personnel without the need for aerial supports.

In a further embodiment, the use of a secure containment system of the present invention on a high voltage electrical apparati also mitigates the requirement for, or at least reduce the size of, a conventional switch yard or substation for securement of said high voltage electrical apparati thereby eliminating or reducing the costs required for same.

Another aspect of the present invention provides secure enclosure systems and designs thereof for attaching to high voltage electrical apparati thereby containing and protecting exposed componentry of said high voltage electrical apparati. Sufficient containment and protection are essential in the electric utility industry so to prevent personal or property damage that may result from accidental contact or tampering with exposed energized componentry of costly high voltage electrical apparati.

In one embodiment, the high-voltage electrical apparati is a high voltage, live-front, transmission transformer wherein the high-voltage phase-to-phase voltage is over about 44,000 V, up to about 250,000 V (phase-to-ground equivalent voltage of about 23,000 to about 144,000 V). Preferably, the high voltage phase-to-phase voltage is between about 60,000 V and about 230,000 V (phase-to-ground equivalent voltage of about 35,000 to about 133,000 V).

In another embodiment, the high voltage electrical apparati is a high voltage circuit breaker.

In a further embodiment, the enclosure system comprises one or more hollow container structures or compartments attached onto, and enclosing componentry exposed on, at least two sides of the high voltage electrical apparatus.

A further aspect of the present invention provides a high voltage, live-front, transmission transformer wherein the exposed componentry is positioned on more than one surface or face of the transformer. In one embodiment, the input conductor terminals of a high voltage, live-front, transmission transformer are segregated from the output conductor terminals with respect to their positioning on difference faces of the transformer.

In a preferred embodiment of the present invention, the secure enclosure system comprises two compartments, each essentially cuboid in shape, attached onto the front and one side of a high voltage, live-front, transmission transformer, enclosing the input (primary) insulators and connections and the output (secondary) connections, respectively, as shown in the accompanying figures.

Other objects, features and advantages of the present invention will become apparent from the following detailed description. It should be understood, however, that the detailed description and the specific examples while indicating preferred embodiments of the invention are given by way of illustration only, since various changes and modifications within the spirit and scope of the invention will become apparent to those skilled in the art from this detailed description.

BRIEF DESCRIPTION OF THE DRAWINGS

For a more detailed disclosure of the invention and for further objects and advantages thereof, reference is to be had to the following description taken in conjunction with the accompanying drawings, in which.

DETAILED DESCRIPTION OF THE INVENTION

Figure 1:
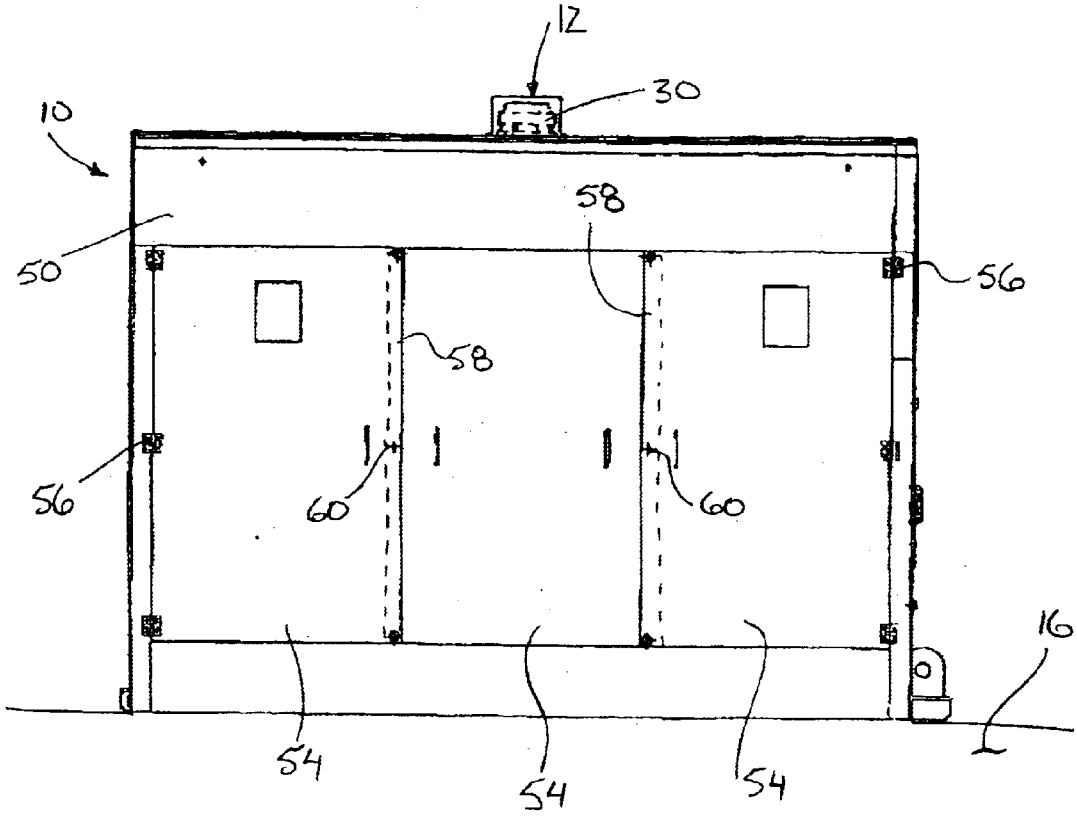
FIG. 1 is a front elevational view of a transformer having an enclosure supported thereon in a closed position.

Referring to the accompanying drawings there is illustrated an enclosure generally indicated by reference numeral 10. The enclosure is particularly suited for use with high voltage electrical handling devices, for example a transmission transformer 12 as illustrated in the accompanying figures. As various embodiments are illustrated, the common features of all of the embodiments will first be described herein.

The transformer generally comprises a rectangular housing 14 which is supported on the ground on a suitable concrete pad 16. The housing includes four sides and a flat rectangular top. High voltage components are located within the housing 14 of the transformer which are suitably arranged for stepping down voltage from a series of high voltage input connectors 18 to a series of output connectors 20.

The transformer includes a conventional core and coil assembly within as well as a cooling radiator 22 projecting from a backside of the housing. Other components of the transformer include lifting lugs 24, a top filter press connection 26, a name plate and connection diagram 28, a pressure relief device 30, an oil level gauge 32, a maximum indicating thermometer 34 and jacking steps 36. A drain valve 38 is also provided projecting from a common side of the housing as the output connectors 20.

The high voltage input connectors 18 are maintained at an upper voltage level of the transformer and generally comprise primary conductors 40 supported at respective ends of insulators 42 spaced outwardly from the housing 14 sufficiently to accommodate a corona field surrounding the conductors 40. The primary conductors 40 remain in communication with the components within the housing. All of the input connectors 18 are supported on a common front side of the housing of the transformer and not on a top side thereof.

The output connectors 20 are maintained at a lower voltage level of the transformer. The output connectors 20 comprise secondary conductors 44 which are mounted within a common secondary face 21B of the housing at right angles and directly adjacent to the common first front side face 21A of the housing supporting the input connectors therein. The output connectors 20 are insulated from the surrounding wall of the housing by respective insulators.

The enclosure 10 includes a main compartment 50 in the form of a container having rectangular walls in the shape of a rectangular box for mounting over top of the input connectors 18 on the front side of the transformer housing. The main compartment 50 includes an opening 52 at an inner side for alignment with the front face of the transformer housing so that the main compartment 50 is arranged to receive the input connectors 18 therein for surrounding and containing the primary conductors at the respective free ends of the insulators of the input connectors. The walls of the main compartment 50 are spaced outwardly sufficiently so as to remain outside of the electrical corona field of the primary conductors 40.

Figure 2:
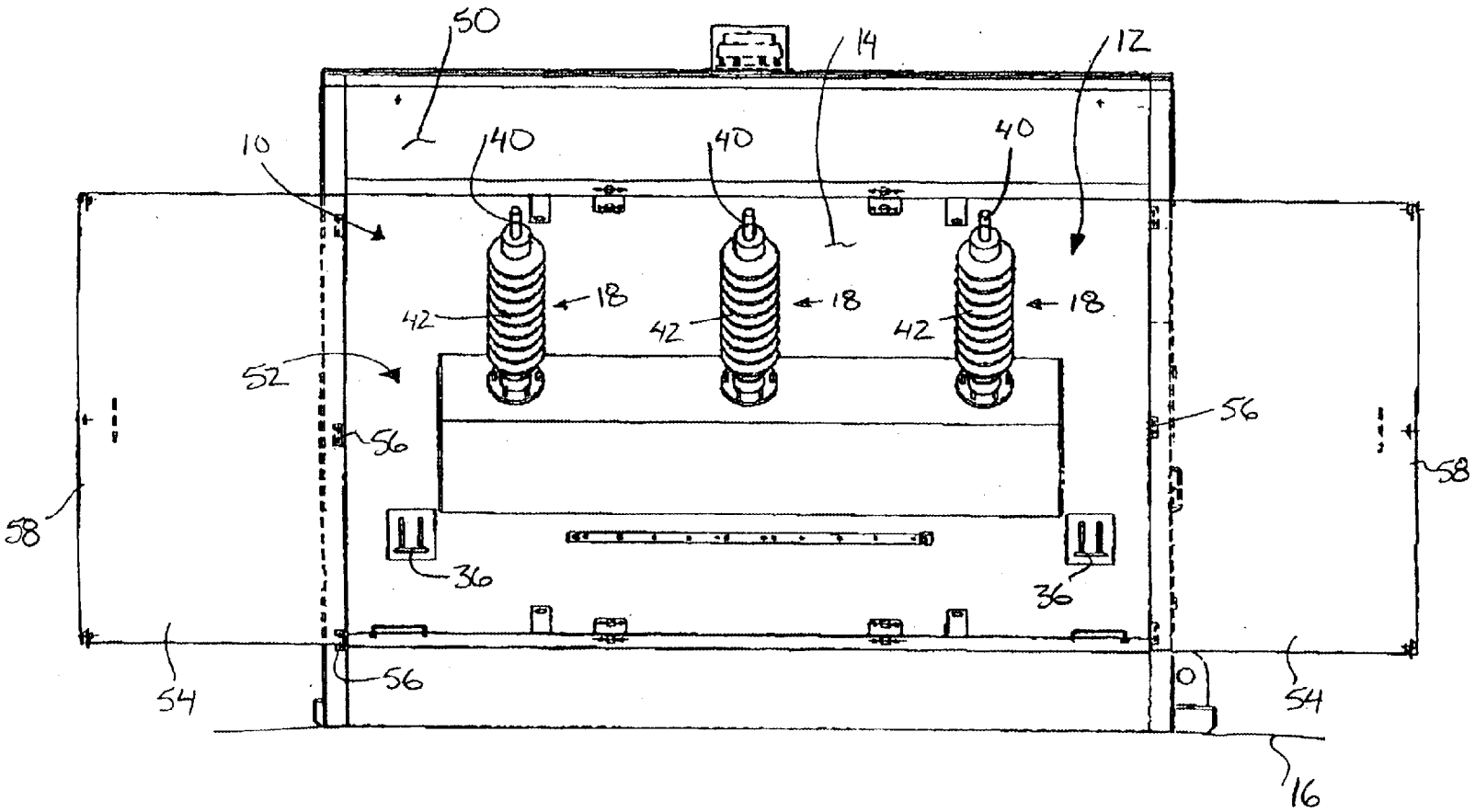
FIG. 2 is a front elevational view of the transformer of FIG. 1 in which the enclosure is opened.
Figure 3:
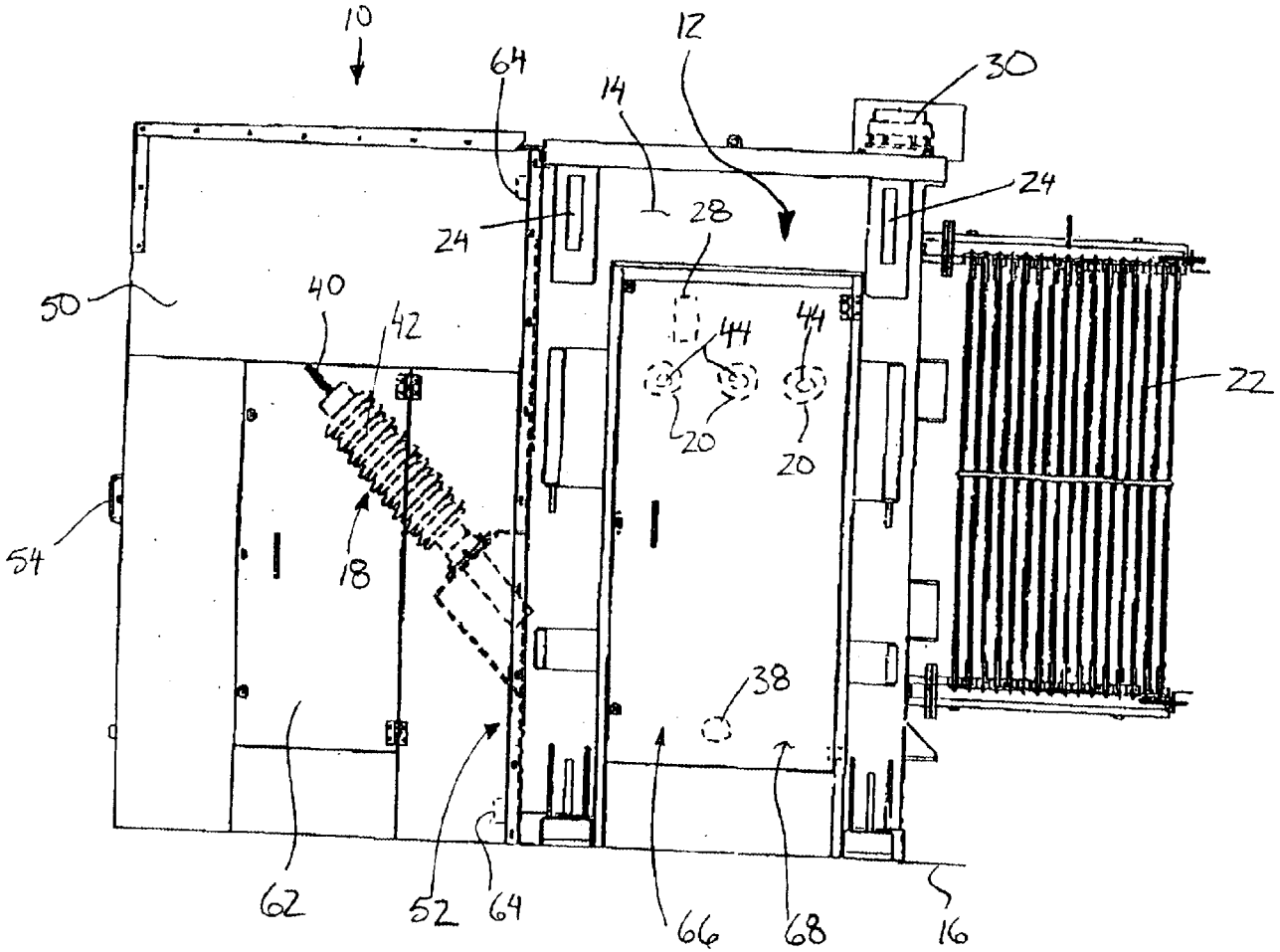
FIGS. 3 and 4 are side elevational views of the transformer of FIG. 1 from opposing sides.
Figure 4:
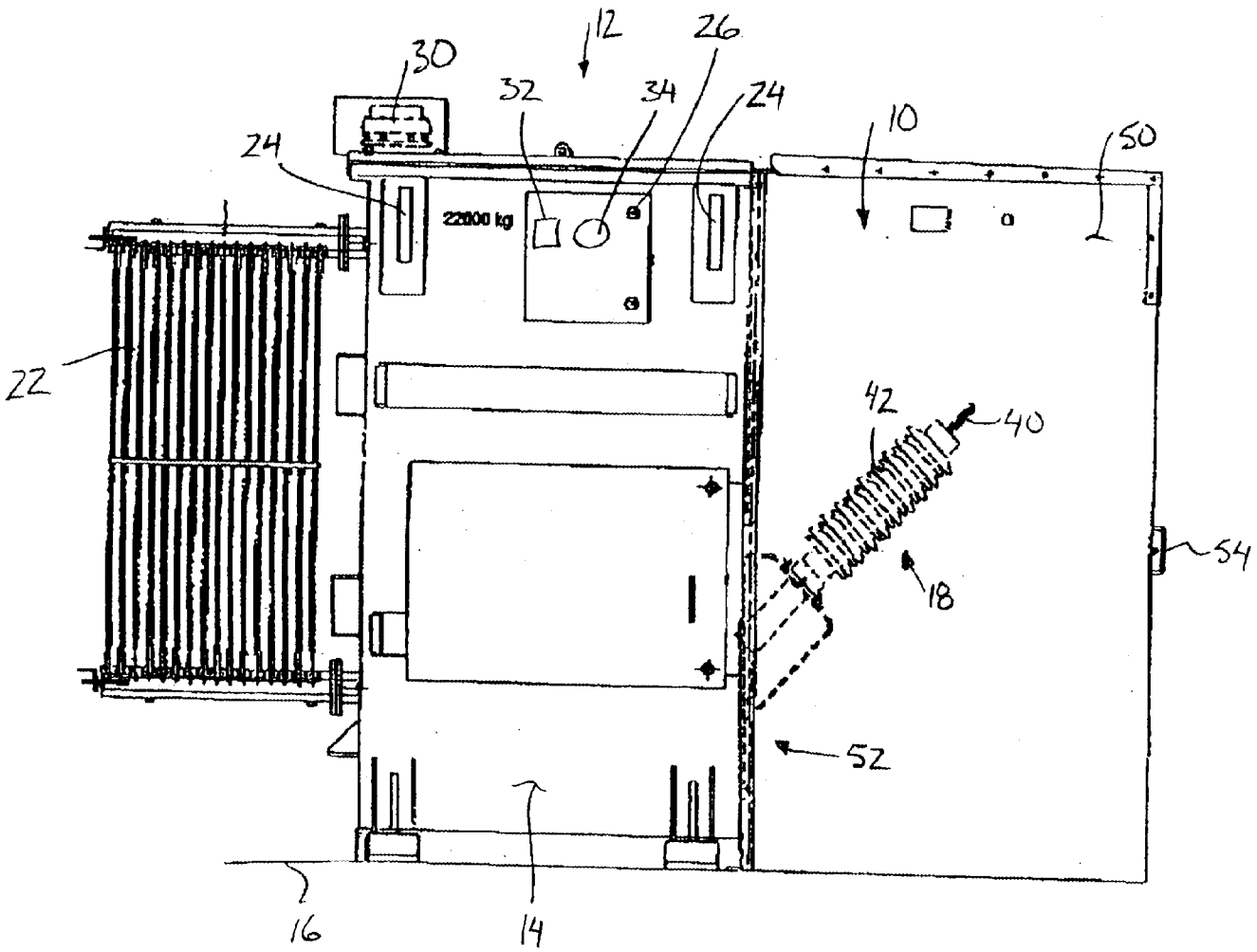
Figure 5:
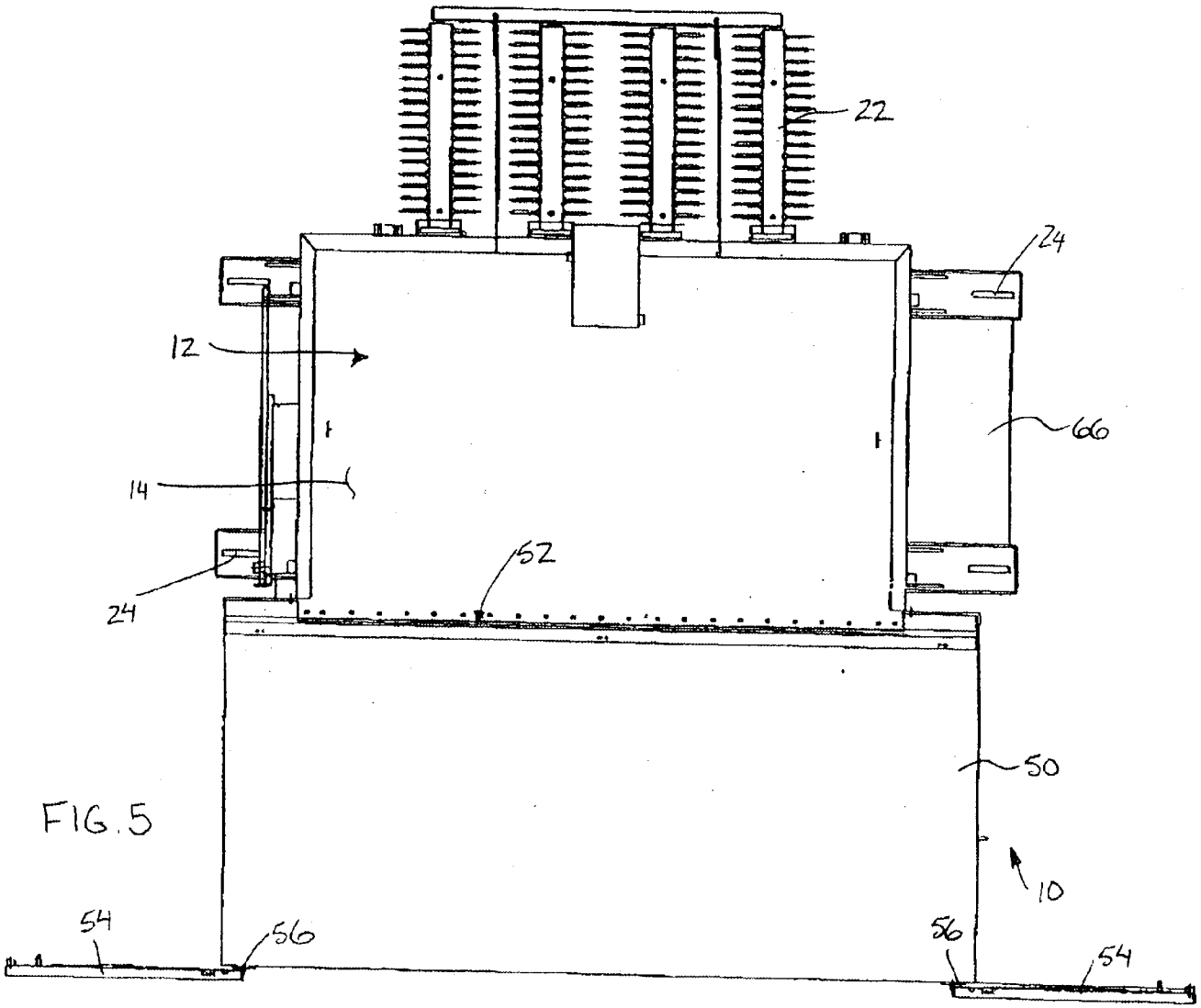
FIG. 5 is a top plan view of the transformer with the enclosure shown in an open position.

The main compartment 50 includes a set of doors 54 located in a common front face of the main compartment, each in association with a respective one of the input connectors 18. An outer pair of the doors 54 include a respective hinge 56 along an outer edge thereof with a flange 58 being located at an inner side for overlapping a respective side of a central one of the doors 54. The overlapping portions of the doors are arranged to receive a padlock 60 as in a conventional locking arrangement. When the doors are in a closed position as illustrated in FIG. 1, the padlocks 60 may be mounted along the overlapping edges of the doors 54 for restricting access by unauthorized persons therethrough. By removing the padlocks the outer pair of the doors 54 may be pivoted open along their respective hinges 56 while the central one of the doors 54 can be removed once it is no longer overlapped by the outer pair of doors, thus providing access to a large opening in the front face of the main compartment 50 as illustrated in FIG. 2 which is clear of door posts despite plural doors being used. An auxiliary door 62 may be provided in an auxiliary side wall of the main compartment 50 at right angles to the front face for visual inspection of the input connectors 18 from a different angle. The auxiliary door 62 is similarly provided with a hinge along one side and a suitable lock arrangement on an opposing side thereof.

The main compartment 50 of the enclosure is arranged to be mounted onto the front side of the transformer housing using suitable threaded fasteners 64 which remain concealed within the enclosure when the doors are in the closed position thereof.

A secondary compartment 66 of the enclosure 10 is also provided, separate from the main compartment 50 for surrounding and enclosing the output connectors 20 of the transformers. The secondary compartment 66 similarly comprises a container having walls arranged to fully surround and enclose the output connectors while having an open inner side arranged to mount adjacent the side wall of the transformer housing by suitable threaded fasteners to permit access to the output connectors when access is provided to the interior of the second compartment. Access to the secondary compartment is provided by a suitable door 68 having a hinge and a lock as described above with regard to the previous doors.

Figure 6:
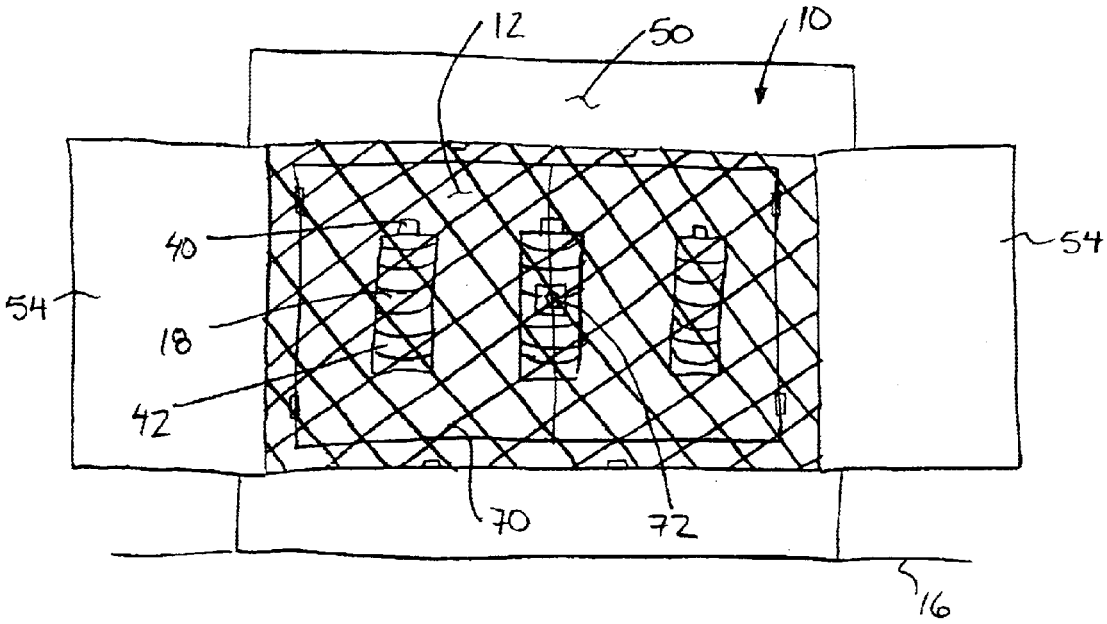
FIG. 6 is a schematic view of a further embodiment of the enclosure shown supported on a transformer.
Figure 7:
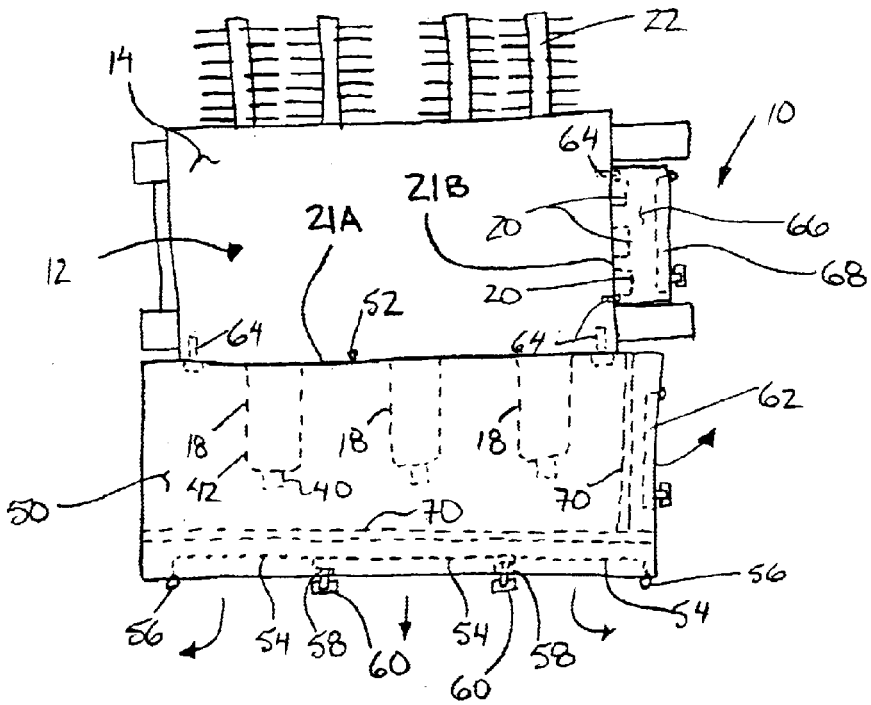
FIG. 7 is a top plan view of the embodiment of FIG. 6.

Turning now to the embodiment illustrated in FIGS. 6 and 7, a secondary barrier 70 is provided within the main compartment 50 of the enclosure 10. The secondary barrier 70 includes a suitable grill which spans the accessible openings of the doors 54 and 62 of the main compartment to restrict access to the input connectors 18 even when the doors are opened. The secondary barrier 70 includes a suitable locking mechanism 72 to restrict access by unauthorized persons in addition to the locks provided on the doors of the main compartment 50. When the locking mechanism 72 of the secondary barrier 70 is released, access to the input connectors 18 is provided by opening a pair of doors formed within the grill of the barrier. The barrier is arranged to be a grill so as to permit visual inspection of the input connectors 18 while remaining positioned outside of the electrical cornea field of the primary conductors 40 as a precautionary measure.

Secure enclosure systems and designs thereof for containing and protecting otherwise exposed and potentially dangerous componentry of high voltage electrical apparati are described herein.

The high-voltage electrical apparati under consideration hereunder may include, without limitation, utility apparati commonly secured in switch yards and substations such as high-voltage, live-front, transmission transformers, a high-voltage circuit breakers or a high-voltage switchgears. For example, high voltage, live-front, transmission transformers and switchgears may be sourced commercially from suppliers such as Alstom® S.A., Asea Brown Boveri® Ltd., and Siemens® AG. Conventional designs of such high voltage equipment generally include input and output conductor connections which are mounted on a top side of the housing of the equipment for open containment in switchyards and the like.

The enclosure system of the present invention comprises one or more hollow container structures or compartments attached onto at least two opposite or adjacent sides of a high voltage electrical apparatus thereby enclosing and protecting otherwise exposed componentry exposed on the sides of said electrical apparatus. For example, the exposed componentry are the input (primary) connections and the output (secondary) connections that are positioned by design on different surfaces of a high voltage, live-front, transmission transformer.

According to one embodiment of the present invention, as illustrated in FIGS. 1 to 5, the enclosure system comprises two hollow container structures, each substantially cuboid in shape, attached respectively onto the front and one side of a commercially available high-voltage (66,000 volts Delta input (HV BIL 350 kV)/2500 kVA or 5000 kVA), three-phase, live-front, 60 Hz, stepdown (low voltage 12470Y/7200 (LV BIL 95 kV)) transmission transformer. The compartment attached to the front of the transformer encloses the input (primary) conductor terminals of the transformer (including the insulators) whilst the compartment attached to the side of the transformer encloses the output (secondary) conductor terminals of the transformer. In the present context, cuboid is a general shape, and therefore does not possess specific properties or limitations with respect to the dimensions of any of the perpendicular faces or perpendicular edges.

Referring to the Figures, mounted on a suitable ground pad is said high voltage, three-phase, live-front, transmission transformer comprising the conventional core and coil assembly within, a cooling radiator, lifting lugs, top filter press connection, nameplate and connection diagram, pressure relief device, oil level gauge, maximum indicating thermometer, and jacking steps. The specifics of said transmission transformer are three-phase; 60 Hz; 65 degree Celcius temperature rise limit; 66,000 V-12,470 V; 5,000,000 VA; ONAN cooled; HV BIL of 350 kV and LV BIL of 95 kV and 8% impedance; but it should be apparent to any skilled person in the art that other transformers of the transmission type, regardless of the specificities such as cooling mechanisms, can also be used in the present invention.

As noted above, according to one embodiment of the present invention, a first integral tank enclosure may be mounted onto the periphery of the front panel of said transformer so that the primary high-voltage input insulators and conductor terminals and the ground spades would be contained by said first tank enclosure. In this embodiment, the primary input conductors are insulated and they enter the first tank enclosure from underground, through the bottom of the tank enclosure, and connect to the conductor terminals.

Also noted above, a second integral tank enclosure is also mounted onto the periphery of one of the side panels of said transformer to contain the exposed secondary output conductor terminals thereon. The output conductors that would be connected to the conductor terminals are also insulated and would exit the second tank enclosure via one or more opening(s) at the bottom of the second tank enclosure to be further transmitted underground. Also contained in tank enclosure are valve drain for the transformer oil, which although does not become energized, but nonetheless chemically and/or thermally hazardous.

Further integral tank enclosure(s) may also be mounted onto any other surface(s) the transformer to cover any other exposed and potentially hazardous componentry.

The size and dimensions of each tank enclosure are determined based on the minimum clearance distances between the closest wall of the enclosure system and energized parts of the exposed componentry required for the safe handling of the tank enclosure. A safe clearance from a conductor terminal would theoretically be of sufficient distance so that the closest wall of the enclosure system remains outside of the electrical corona generated by said conductor terminal. For the purpose hereof, a corona can be defined as a localized dielectric breakdown of gas insulation (e.g. air) due to locally large electric field. For example, the minimum clearance distances that would be required between the closest wall of the enclosure system and the exposed connector at the tip of an insulator extruding out of the front panel of the high voltage, live-front, transmission transformer may be calculated following the general function of at least about 0.01 meter or at least about 0.4 inches per every thousand volts of handling capacity of the transformer (i.e. omnidirectional clearance of at least about 0.66 meter or at least about 26.4 inches between an energized terminal and the closest enclosure wall for the input terminals of a 66,000 volt Delta transformer). The aforementioned formula and clearance distance calculations will be applicable to transformers with maximum input phase-to-phase voltages of up to about 230,000 V Delta, preferably of up to about 250,000 V Delta.

It should be readily apparent to a skilled person in the art that as the input (primary) conductor terminals and output (secondary) conductor terminals (and neutral connection) exposed on this transformer model are positioned on adjacent sides of the transformer, enclosure of both sets of conductor terminals may be accomplished by one single L-shaped integral tank spanning the periphery of both sides of the transformer. The two perpendicular interior corridors inside such a single L-shaped integral tank may be in open communication with each other, or they may be divided by an actual physical means, such as a plate divider, to separate the two corridors or compartments, provided that all clearance specifications are met. It should also be readily apparent to a skilled person in the art that although the layout of the tank enclosure in the present exemplified embodiment is substantially cuboid in shape, other shapes and layouts may also be deployed so long as the tank enclosure is sufficiently designed to accommodate the exposed componentry such as the input and output conductor terminals with proper clearance distances as taught above.

Each of the integral tank enclosures described above may be made of any material that would provide sufficient strength, rigidity, resilience, heat and corrosion resistance, and durability. Preferably, said tank enclosures are metal tank enclosures and stainless steel would be a cost-effective material. Alternatively, lighter weight aluminum or other metal alloys may be used at higher costs. Further, other suitable materials such as composites and polymers exhibiting the above required characteristics may be used either to construct a single-layered tank enclosure, or in view of the insulative properties and quality of some composites or polymers, overlaid in conjunction with sheet metal to form a multiple layer construct.

The integral tank enclosures of the present invention may be made from a single piece of a desired material that is bent into the desired shape, or may be made from multiple pieces of the material with their edges attached together by conventional joining means such as welding, gluing, and/or point contact (e.g. bolting) means, where practicably suitable. Similarly, each tank enclosure may be mounted onto the transformer by conventional means such as via bolt- or weld-connections. Preferably, the top (roof) panels of each of the tank enclosures are designed and constructed with one or more slant(s) sufficient for drainage purposes.

Access to the electrical componentry within each tank enclosure may be accomplished by placing one or more openings on one or more surface(s) of the tank enclosure, or by actually or temporarily removing or displacing the entire tank enclosure. In the present example, two access openings are present on the tank enclosure containing the input (primary) terminals, while a single access opening is present on the tank enclosure containing the output (secondary) terminals.

For safety and security reasons, one or more recessed enclosure doors may each be pivotally attached to a side edge of an access opening by means of hinges, sliding means, or the like. It should be obvious to a skilled artisan in the field that a door access opening may not be practicable for a smaller tank enclosure and that it may be preferred for the entire tank enclosure to be removably or pivotally mounted onto the transformer so that access to the electrical componentry may be achieved simply by temporarily removing or opening the tank enclosure.

It should also be readily apparent that the tank enclosure and/or doors attached thereto should be constructed in a manner to accommodate the incorporation of conventional locking means such as pad-locks, deadbolts, or other higher security locking mechanisms as may be described in Hetherington in U.S. Pat. No. 6,106,035. In the present embodiment, locking fixtures are constructed as integral parts of tank enclosures, respectively, so to accommodate and effect padlocking of the recessed enclosure doors. Similarly, the enclosure on at the output side also comprises means for padlock attachment.

As noted above with regard to FIGS. 6 and 7, to further improve the safety and security of the present invention, additional security means may be incorporated into the system. Such means may include the placement of additional barriers to cover the access opening(s) of each tank enclosure which additional barrier may also be temporarily removable or openable. Preferably, such additional barrier is transparent or see-through and suitable formats may be a mesh screen, one or more substantially parallel security bars, or a transparent polymer sheet, placed beyond (hence protect user from) the electrical corona of the electrical componentry. Further, conventional monitoring devices that produces one or more humanly perceivable signal, locally or remotely, when a tank enclosure and/or door is open, may also be included to signal work in progress or any breach of security of the enclosure system.

In other aspects of the present invention, the inventors contemplate the method of use or application of a secure containment system for containing hazardous componentry in a high-voltage electrical apparati so to: (i) facilitate access and maintenance by authorized personnel without the need for aerial supports; and/or (ii) mitigate the requirement for, or at least reduce the size of, a conventional switchyard or substation for securement of said high-voltage electrical apparati thereby eliminating or reducing the costs required for same. It should be obvious to a skilled artisan that the present secure enclosure systems may be mounted onto the transformer at the time of manufacture by the transformer manufacturer or they may be offered as an after market feature or kit that may be purchased and installed by a distributor or user of the transformer through simple mounting procedures such as welding or bolting.

All publications, patents and patent applications referred to herein are incorporated by reference in their entirety to the same extent as if each individual publication, patent or patent application was specifically and individually indicated to be incorporated by reference in its entirety.

Having illustrated and described the principles of the invention in a preferred embodiment, it should be appreciated to those skilled in the art that the invention can be modified in arrangement and detail without departure from such principles. The invention is to be considered limited solely by the scope of the appended claims.

What is claimed is:

1. In a high voltage electrical handling device, such as a transformer, the device comprising a housing containing electrical componentry, at least a portion of the electrical componentry comprising high voltage electrical componentry, at least one first connector supported externally of the housing in communication with the high voltage electrical componentry said at least one first connector being at a high voltage with a minimum phase to phase high voltage of at least 44,000 volts and having a surrounding electrical corona field and at least one second connector supported externally of the housing in communication with the electrical componentry:

wherein the improvement comprises a first common face of the housing supporting said at least one first connector therein and a second common face of the housing supporting said at least one second connector therein;

the first common face and the second common face being oriented transversely to one another at different sides of the housing; and an enclosure comprising walls connected to the housing surrounding said at least one first connector at high voltage, spaced outside of the electrical corona field of said at least one first connector and surrounding said at least one second connector.

2. The high voltage electrical handling device according to claim 1 wherein the device comprises a high voltage transmission transformer.

3. The high voltage electrical handling device according to claim 1 wherein said at least one first connector comprises an input voltage connector and said at least one second connector comprises an outlet voltage connector.

4. The high voltage electrical handling device according to claim 1 wherein said at least one first connector is spaced outwardly from the housing, supported at the free end of an insulator projecting from the housing.

5. The high voltage electrical handling device according to claim 1 wherein said at least one connector has a minimum phase to phase high voltage of at least 60,000 Volts.

6. The high voltage electrical handling device according to claim 1 wherein said at least one second connector comprises a lower voltage connector supported on a second side of the housing and said at least one first connector comprises an upper voltage connector supported on a first side of the housing, both the upper and lower voltage connectors being enclosed by the enclosure.

7. The high voltage electrical handling device according to claim 1 wherein the enclosure comprises a first compartment surrounding said at least one first connector on a first side of the housing and a second compartment surrounding said at least one second connector on a second side of the housing.

8. The high voltage electrical handling device according to claim 1 wherein the enclosure includes a an access door supported therein having locking means to restrict access by unauthorized persons.

9. A high voltage electrical handling device according to claim 8 wherein there is provided a secondary barrier supported within the enclosure for restricting access to the connectors through the access door, both the access door and the secondary burner for restricting access to the surrounding electrical corona field of the connectors by unauthorized persons.

10. The high voltage electrical handling device according to claim 9 wherein the secondary barrier comprises a grill permitting visual inspection therethrough, located outside of the electrical corona field of the connectors.

11. The high voltage electrical handling device according to claim 9, wherein the secondary barrier located outside of the electrical corona field of the connectors permits visual inspection of the connectors therethrough.

12. The high voltage electrical handling device according to claim 1 wherein the enclosure includes an access door supported therein in association with each of the connectors.

13. The high voltage electrical handling device according to claim 1, wherein the enclosure is arranged to be connected to the housing using threaded fasteners.

* * * * *

UNITED STATES PATENT AND TRADEMARK OFFICE

CERTIFICATE OF CORRECTION

PATENT NO. : 6,770,810 B2
APPLICATION NO. : 10/364512
DATED : September 14, 2005
INVENTOR(S) : Ernst Wiebe and Caron Hopkner It is certified that error appears in the above-identified patent and that said Letters Patent is hereby corrected as shown below:

On the title page item [73]:
The Assignee should read "The Manitoba Hydro-Electric Board, Winnipeg, Manitoba, Canada and Partner Technologies Inc., Regina, Saskatchewan, Canada."

Signed and Sealed this

Nineteenth Day of December, 2006

JON W. DUDAS
*Director of the United States Patent and Trademark Office*

UNITED STATES PATENT AND TRADEMARK OFFICE

CERTIFICATE OF CORRECTION

PATENT NO. : 6,770,810 B2
APPLICATION NO. : 10/364512
DATED : August 3, 2004
INVENTOR(S) : Ernst Wiebe and Caron Hopkner It is certified that error appears in the above-identified patent and that said Letters Patent is hereby corrected as shown below:

On the title page item [73]:
The Assignee should read "The Manitoba Hydro-Electric Board, Winnipeg, Manitoba, Canada and Partner Technologies Inc., Regina, Saskatchewan, Canada."

This certificate supersedes Certificate of Correction issued December 19, 2006.

Signed and Sealed this

Thirtieth Day of January, 2007

JON W. DUDAS
*Director of the United States Patent and Trademark Office*